US005188424A

United States Patent [19]

Herron

[11] Patent Number: 5,188,424

[45] Date of Patent: Feb. 23, 1993

[54] PORTABLE SEAT

[76] Inventor: Donald F. Herron, Rte. 1, Dent, Minn. 56528

[21] Appl. No.: 819,290

[22] Filed: Jan. 13, 1992

[51] Int. Cl.[5] ..... A47C 1/10

[52] U.S. Cl. ..... 297/440; 248/410

[58] Field of Search ..... 297/440, 175; 248/410, 248/161, 530, 532, 533

[56] References Cited

U.S. PATENT DOCUMENTS

| | | | |
|---|---|---|---|
| 77,676 | 5/1868 | Swett | 248/410 X |
| 998,982 | 6/1911 | Moore et al. | 240/410 |
| 2,503,359 | 4/1950 | Smith | 240/410 X |
| 3,195,531 | 7/1965 | Groft | 248/410 X |
| 3,312,115 | 4/1967 | Braselmann | 248/410 X |
| 4,501,201 | 2/1985 | Fitzner | 211/107 X |

*Primary Examiner*—Jose V. Chen

*Attorney, Agent, or Firm*—Palmatier, Sjoquist & Helget

[57] ABSTRACT

A portable seat mountable onto a rod extending upward from the ground has a substantially planar base with a peripheral edge therearound defining a central seating surface. The base has an aperture therethrough adjacent the edge. The aperture is adapted to receive the rod therethrough and grip the rod above the ground to provide the base as a portable seat adapted to receive and support a human posterior to permit the human to take a seated position above and off the ground.

4 Claims, 1 Drawing Sheet

PORTABLE SEAT

BACKGROUND OF THE INVENTION

This invention relates to a portable seat and more particularly to such a seat mountable onto a rod extending upward from the ground.

With many outdoor activities, such as baseball, softball, fishing, hunting and simply being a spectator, one's legs can get tired. Consequently, the person on occasion during his or her outdoor activity often desires to be seated to rest his or her legs. However, the availability of chairs or benches in the vicinity of many such activities are scarce. What this means is that the person must bring along his or her own seat.

Portable seats are generally known in the form of folding chairs or camp stools. However, such seats or chairs are cumbersome, difficult to collapse and erect, and are not easily transportable.

There is a need for a portable seat that is extremely compact and readily transportable. Such a seat should be adaptable to fit upon a variety of vertical rod-like structures as to permit the individual to take the seated position and rest one's legs.

SUMMARY OF THE INVENTION

A portable seat mountable onto a rod extending upward from the ground has a substantially planar base with a peripheral edge therearound defining a central seating surface. The base has an aperture therethrough adjacent the edge. The aperture is adapted to receive the rod therethrough and grip the rod above the ground to provide the base as a portable seat adapted to receive and support a human posterior to permit the human to take a seated position above and off the ground.

A principal object and advantage of the present invention is that the portable seat is substantially flat, compact and easily storable as well as transportable and which can be made out of a minimum amount of inexpensive plastic material.

Another object and advantage of the present invention is that the portable seat lends itself to be supported by any of a variety of vertically oriented rods from which the portable seat may be suspended therefrom.

Another object and advantage of the portable seat is that it may take any of a variety of planar shapes while the seating surface may be sculptured or contoured to readily fit to the bottom shape of the human posterior in a comfortable fashion.

Another object and advantage of the present invention is that it is readily usable with a variety of outdoor activities such as camping, hunting, fishing, softball, baseball or viewing others engaged in activities.

Other distinct advantages and objectives will be come apparent upon the reading of the specification, appended claims and drawings.

DETAILED SPECIFICATION

Figure 3:
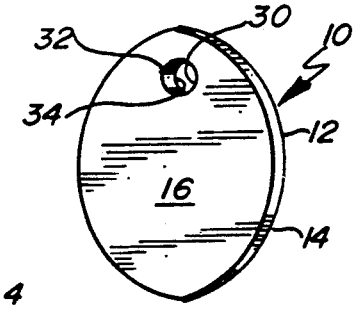
FIG. 3 is yet another modified shape of the portable seat of the present invention.
Figure 1:
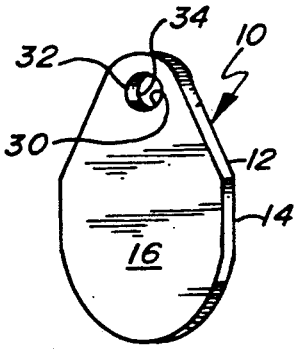
FIG. 1 substantially a plan view of the portable seat of the present invention in one particular embodied shape.
Figure 4:
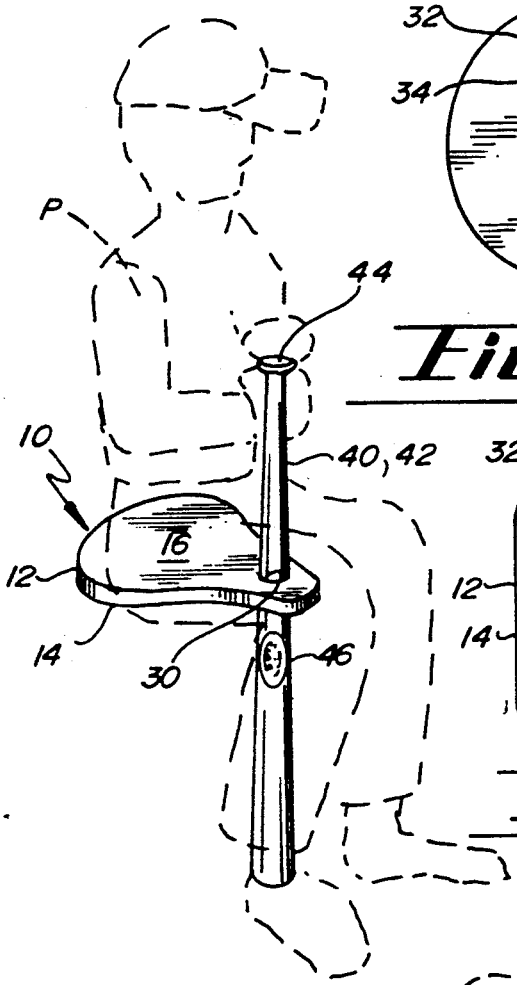
FIG. 4 is a perspective view of a person in broken outline in a seated position upon the portable seat supported by a baseball or softball bat.
Figure 2:
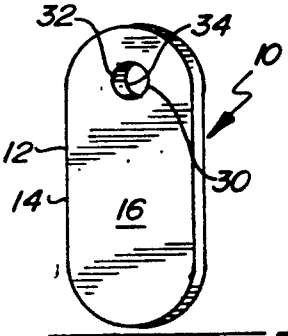
FIG. 2 is another plan view of a modified shape of the portable seat.
Figure 5:
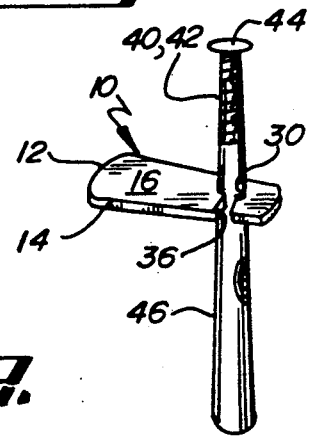
FIG. 5 is a front perspective view of yet another modified portable seat horizontally supported by a baseball or softball bat.

Referring to FIGS. 1–8, the portable seat 10 of the present invention may generally be seen. The seat 10 generally includes a substantially planar base 12 having a peripheral edge 14 therearound defining a central seating surface or top surface 16. Adjacent the edge is an aperture 30 therethrough as will be fully appreciated below.

More specifically, the portable seat 10 suitably may be made of a plastic material approximately three quarters of an inch thick with a width in the range of 6 to 12 inches and a length in the range of 13 to 16 inches. The invention may either be cut out of large plastic sheets or be of a molded design. As can be seen from the Figures, the seat 10 may take a variety of substantially planar base 12 shapes. The peripheral edge 14 may or may not be beveled if it adds some level of comfort to the individual user. The top surface or central seating surface 16 suitably may be sculptured, contoured or dished 18 to conform to the shape of the human posterior. These illustrative dimensions are not intended to be limiting but are to show the varied embodiments this invention may take.

The aperture 30 extending through the planar base 12 adjacent the peripheral edge 14 is appropriately in the range between 1⅞ inch to 2½ inches in diameter as will appreciated for baseball or softball bat 42 applications. On the top surface 16 at aperture 30 is the upper rim 32 while the lower rim 34 of aperture 30 is located on the bottom surface or side 20. For some embodiments of the present invention, slot 36 appropriately extends from the aperture 30 through to the peripheral edge 14. On some other embodiments, an elastomeric insert 38 may be placed in the aperture as to line aperture 30.

As stated, the portable seat 10 may be supported by a variety of vertical oriented rod-like 40 devices. Rod 40 may take the shape of a bat 42 having a handle knob 44 approximately 1⅞ inches in diameter with a hitting surface 46 approximately 2½ inches in diameter. Alternatively, the rod 40 may take the shape of a post common on most boat or fishing docks 52. Rod 40 may also take the shape of a small tree trunk 54 or a pole 56 of some kind.

Referring to FIGS. 4–7, the operation of the portable seat may be understood and appreciated. Firstly, considering the operation of the seat 10 with a bat 42, the aperture 30 with a diameter is aligned to receive the handle knob 44 of a smaller diameter. As the bat 42 is slid upwardly into aperture 30, eventually the lower rim 34 of aperture 30 binds and becomes friction fitted along the hitting surface 46. Because the bat handle knob 44 is typically 1⅞ inches in diameter and the hitting surface is approximately 2½ inches in diameter, it is desirable for this application that the aperture 30 have a diameter in the range of 1⅞ inches to 2½ inches. By this arrangement, a substantial portion of bat 42 may be received in aperture 30 and come to rest on the hitting surface 46 substantially above the ground to offer the central seating surface for a human to take a balanced seated position thereon.

Should the case be that the rod-like device 40 is substantially elongate or has a handle knob 44 of a diameter larger than that of aperture 30, it is appropriate to have slot 36 through the peripheral edge 14 into the aperture 30. By this arrangement, the support rod 40 is simply passed through the slot 36 and into the aperture 30 after which the planar base 12 may be moved downwardly until it achieves a friction fit. The slot 36 arrangement of portable seat 10 may also work with bat 42 should a person want the seat 10 to sit high on hitting surface 46 with disregard to the aperture 30 fitting over handle knob 44.

Figure 6:
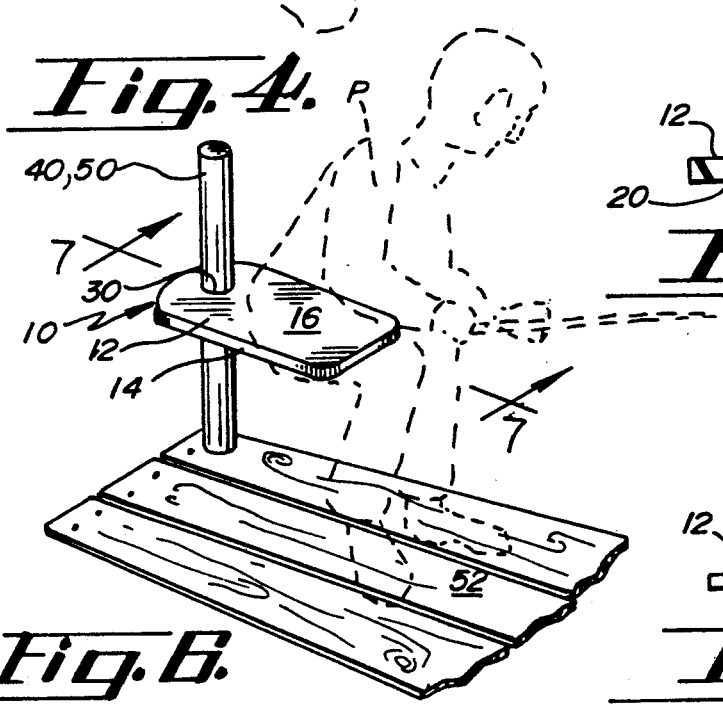
FIG. 6 shows another embodiment of the portable seat supported by a dock post with a person in broken outline sitting thereon.
Figure 7:
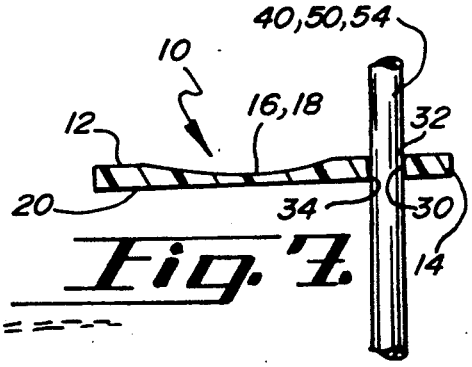
FIG. 7 is a cross-sectional view taken along lines 7—7 of FIG. 6 showing some contour to the central seating surface of the portable seat.

Referring to FIGS. 6 and 7, occasionally it will be desired to mount the portable seat 10 upon a rod 40 which is substantially of even diameter throughout its length. FIG. 6 shows a dock 52 with a post 50 of substantially even diameter. As the seat 10 is slid over the post 50, the persons simply stops at the general locale where he desires the seat 10 to be horizontally positioned. Thereafter, a downward force, as in seating, is exerted on the central seating surface 16 as to bind the upper and lower rims 32 and 34 into the post 50. That is, the upper and lower rims 32 and 34 act as sharp edges to grip or bite the post 50.

Figure 8:
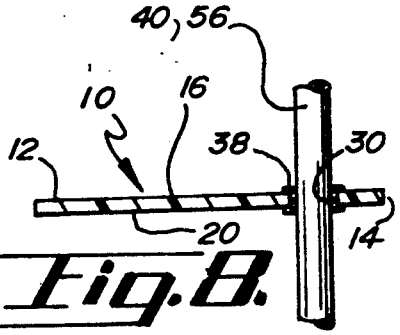
FIG. 8 is a cross-sectional view similar to FIG. 7 with an elastomeric insert placed in the aperture of the portable seat.

FIG. 8 shows that an elastomeric insert 38 may be placed or inserted into aperture 30. By this arrangement, the downward force as from seating upon the central seating surface 16 creates a binding force with rims 32 and 34 much like FIG. 7 that is conveyed to rod 40 or pole 56 through the elastomeric insert 38. The insert 38 insures that the pole 56 does not become scratched or marred which otherwise may occur should the pole 56 contact upper and lower rims 32 and 34 instead of the elastomeric insert 38. The insert 38 may also provide a better friction fit.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A portable bat seat supported by the ground and extending upwardly, the seat being adapted to receive and support a human posterior to permit the human to take a balanced seated position thereon above and off the ground, comprising:

(a) a ball bat having a handle knob end, an intermediate hitting surface of a diameter that continuously becomes larger with respect to the handle knob end and a blunt end;

(b) a substantially planar base with a peripheral edge therearound defining a central seating surface and having a completely flat bottom surface; and (c) an aperture through the base adjacent the edge, the aperture being of a size that is at least as large as the handle knob end and smaller than the largest diameter of the intermediate hitting surface so as to receive the handle knob and a portion of the hitting surface of the bas upright and vertically therethrough and to grip the bat at the hitting surface above the ground to provide the base as the portable seat for the seated human to balance the bat and the base on the blunt end of the bat resting on the ground.

2. The portable seat of claim 1, wherein the aperture has an upper rim and a lower rim at least one of which binds upon the bat when a downward force is exerted on the seating surface.

3. The portable seat of claim 1 further comprising a slot between the aperture and the peripheral edge.

4. The portable seat of claim 1 further comprising an elastomer liner insertable into the aperture.

* * * * *

UNITED STATES PATENT AND TRADEMARK OFFICE

CERTIFICATE OF CORRECTION

PATENT NO. : 5,188,424

DATED : February 23, 1993

INVENTOR(S) : Donald F. Herron

It is certified that error appears in the above-identified patent and that said Letters Patent is hereby corrected as shown below:

In Col. 4, Line 28, delete the word "bas" and insert therefor --bat--.

Signed and Sealed this

Sixteenth Day of November, 1993

*Attest:*

Bruce Lehman

BRUCE LEHMAN

*Attesting Officer*

*Commissioner of Patents and Trademarks*